United States Patent [19]

McCurry, III

[11] 4,366,764

[45] Jan. 4, 1983

[54] APPARATUS FOR FORMING LOOPS OF STRIP MATERIAL

[75] Inventor: Eugene McCurry, III, Humbolt, Tenn.

[73] Assignee: Kellwood Company, St. Louis, Mo.

[21] Appl. No.: 176,392

[22] Filed: Aug. 8, 1980

[51] Int. Cl.[3] ..... D05B 23/00

[52] U.S. Cl. ..... 112/121.27; 112/DIG. 2

[58] Field of Search ..... 112/121.27, 121.26, 112/2, 121.12, 121.15, DIG. 2

[56] References Cited

U.S. PATENT DOCUMENTS

| | | | |
|---|---|---|---|
| 3,426,708 | 2/1969 | Andersson | 112/121.27 |
| 3,777,683 | 12/1973 | Lee | 112/121.27 |
| 3,780,679 | 12/1973 | Hanes, Jr. et al. | 112/121.27 |
| 3,949,688 | 4/1976 | Andersson | 112/121.26 |
| 4,075,956 | 2/1978 | Manetti | 112/121.27 |

*Primary Examiner*—H. Hampton Hunter

*Attorney, Agent, or Firm*—Senniger, Powers, Leavitt and Roedel

[57] ABSTRACT

Apparatus for forming loops of strip material, with each loop comprising a length of the material having its ends secured together, comprising a sewing machine for stitching ends of the length of strip material together to form it into a closed loop, and nozzles for directing air under pressure at the material for intermittently feeding a length of the stip material from a supply. A guide is provided for guiding the leading end portion of the strip material as it is fed forward from the supply generally into the form of a U extending down on one side of the sewing machine and up on the other side of the sewing machine. A cutter is provided for cutting the strip material at the trailing end of the U-shaped leading end portion of the strip material to provide a generally U-shaped length of the material with the sides of the U-shaped length of material extending on opposite sides of the sewing machine. Folding members fold over the ends of the U-shaped length of material to bring them together on the bed of the sewing machine for being stitched together by the sewing machine.

21 Claims, 7 Drawing Figures

APPARATUS FOR FORMING LOOPS OF STRIP MATERIAL

BACKGROUND OF THE INVENTION

This invention relates to apparatus for forming loops of strip material, and more particularly apparatus for forming loops of elastic strip material which loops are to be incorporated in garments having a stretchable waistband.

This invention involves an improvement in loop forming apparatus of the type such as shown for example in U.S. Pat. Nos. 3,426,708 and 3,780,679 generally comprising a sewing machine, means for cutting a length of strip material, and means for positioning the ends of the length of strip material on the bed of the sewing machine with one end butting against or overlapping the other so as to form a loop, the sewing machine stitching the ends of the strip material together to form a completed loop.

SUMMARY OF THE INVENTION

Among the several objects of this invention may be noted the provision of an improved apparatus of the above described type which automatically makes loops of strip material; the provision of such apparatus which forms loops of elastic strip material while the elastic strip material is held in unstretched condition; the provision of such apparatus in which completed loops are automatically removed from the apparatus; the provision of such apparatus which has fewer moving parts and operates more reliably than the prior art loop forming apparatus; and the provision of such apparatus which is of relatively simple, economical construction.

In general, apparatus of this invention comprises means (e.g., a sewing machine) for securing the ends of a length of strip material together to form it into a closed loop, means for intermittently feeding a length of strip material from a supply, and means for guiding the leading end portion of the strip material as it is fed forward from the supply generally into the form of a U extending in one direction on one side of said securing means and back in the opposite direction on the other side of said securing means. Means is provided for cutting the strip material at the trailing end of the U-shaped leading end portion of the strip material to provide a generally U-shaped length of the material with the sides of said U-shaped length of material extending on opposite sides of said securing means. Folding means folds the ends of said U-shaped length of material over to bring them together in the securing means for being secured together by the latter, said securing means being operable upon the folding over of said ends for securing them together.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 5:
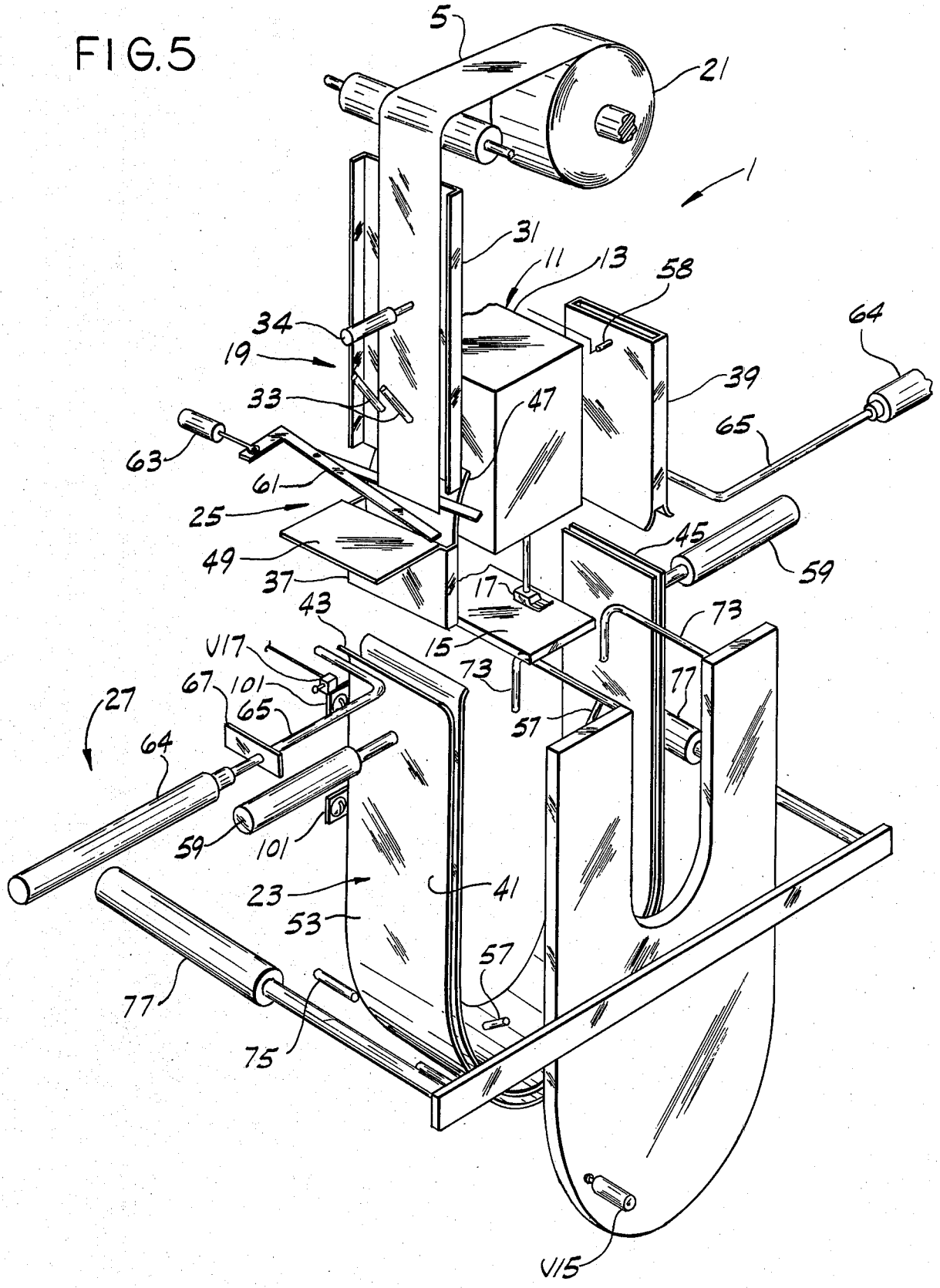
FIG. 5 is a view similar to FIG. 4 showing the apparatus with the completed loop removed.

Referring to the drawings, there is generally indicated at 1 apparatus of this invention for forming loops 3 of strip material 5 such as elastic fabric material for stretchable waistbands for men's underwear. Each loop comprises a length of the strip material having its ends 7, 9 secured together. The apparatus 1 comprises means generally indicated at 11, such as a conventional sewing machine 13 for securing the ends of a length of the material 5 together to form it into a closed loop 3. The bed and presser foot of the sewing machine are indicated at 15 and 17. At 19 is indicated means for intermittently feeding a length of the material from a supply 21, and at 23 is indicated means for guiding the leading edge portion of the material as it is fed forward from the supply generally into the form of a U extending down on one side of the bed 15 of the sewing machine and up on the other side of the bed. At 25 is indicated means for cutting the strip material at the trailing end 9 of the U-shaped leading end portion to provide a generally U-shaped length of the material with the sides thereof extending on opposite sides of the bed 15 of the sewing machine. At 27 is indicated means for folding over the ends 7, 9 of the U-shaped length of material to bring them together on the bed 15 in abutting or overlapping relation for being stitched together by the sewing machine 13, the sewing machine being operable upon the folding over the ends for stitching them together. As shown in FIG. 5, the sewing machine and the guiding means 23 are formed to enable edgewise removal of each completed loop 3, means 29 being provided for removing each completed loop from the guiding means 23.

More particularly, the means 19 for feeding the strip material to the guide means 23 comprises means, such as a guide channel 31, for backing the material 5 leading from the supply 21 to the guiding means 23, and a pair of nozzles 33 for directing air under pressure from a source thereof at the material to feed it forward (down) past the cutting means 25. An air cylinder unit 34 is provided for holding the material 5 against the channel 31 until the material is to be fed forward to the guide means 23.

The guide means 23 comprises entry and exit reaches 37, 39 each having upper and lower ends, and a U-shaped central reach 41. The central reach 41 has an entrance end 43 below the lower end of the entry reach 37 and an exit end 45 below the lower end of the exit reach 39, the ends 43, 45 being generally at the level of the bed 15 of the sewing machine. The entry reach 37 of the guide means comprises an inner member 47 and an outer member 49, these members being outwardly divergent at the upper end of the entry reach. Air nozzle means (not shown) may be provided for directing air under pressure toward the inner member 47 for holding the material in engagement therewith. The central reach 41 comprises an inner member 51 and an outer member 53 in spaced relation relative to the inner member.

To feed the strip material 5 forward through the guide means 23, air nozzle means 57 is provided in the central reach 41 of the guide means comprising a plurality of nozzles at spaced intervals along the inner member 51 angled toward the exit end 45 of the central reach for directing air under pressure thereto. A sensor 58 is provided at the upper end of the exit reach 39 operable to sense the presence of the leading edge 7 of the strip material for terminating the feeding of the material and for initiating operation of the cutting means 25 and the folding means 27. To hold the material 5 in the guide means against longitudinal movement when the ends 7, 9 of the length of strip material are being folded on the bed 15 of the sewing machine 13, holding means is provided in the central reach 41 comprising a pair of pneumatic cylinder units 59 on opposed sides of the outer member 53, each having a piston movable toward the inner member 51 for holding the strip material against the inner member.

The cutting means 25 comprises a pair of blades 61 mounted above the upper end of the entry reach 37, the blades being normally spaced apart to enable the material to be fed between the blades toward the guide means 23. An air cylinder unit 63 is provided to move one blade toward the other to cut the material 5 at the trailing end 9 of the material 5.

The folding means 27 folds the leading and trailing ends 7, 9 of the material down on the bed 15 of the sewing machine. It comprises a pair of air cylinder units 64 each having a piston rod formed into a folding member 65 movable from a retracted position outward of the central reach 41 to an extended position over the bed 15 of the sewing machine 13. One folding member is movable between the lower end of the entry reach 37 and the entrance end 43 of the central reach 41, the other folding member being movable between the exit end 45 of the central reach 41 and the lower end of the exit reach 39. A projection 67 is secured to one of the folding members 65, the projection being engageable with a sensor constituted by the valve V17, when the folding member is in extended position, for actuating the cylinder units 64 to return the folding members 65 to their retracted position, and for initiating the operation of the sewing machine 13 for stitching the ends 7, 9 of the material 5 together to form the completed loop 3.

The means 29 for removing the completed loop 3 comprises a cover plate 71 having a pair of hooks 73 mounted thereon engageable with an edge of the loop 3 at a top portion thereof, and a nozzle 75 at the lower end of the central reach 41 for directing air under pressure at the completed loop 3 between the inner and outer members 51, 53 of the central reach 41. The cover plate 71 is movable between a first position wherein it engages the inner and outer members 51, 53 thereby functioning as an edge member of the central reach 41, and a second position away from the inner and outer members for edgewise removal of the completed loop 3 from the guide means 23. The nozzle 75 directs air under pressure at a lower portion of the completed loop 3 when the cover plate 71 moves to its second position for assisting the cover plate in the edgewise removal of the loop 3.

To move the cover plate 53 between its first position wherein it engages the guide means 23 and its second position for removing the completed loop 3, a pair of pneumatic cylinder units 77 are provided. First and second sensors constituted by valves V14 and V15 engageable by the cover plate are provided to detect the position of the cover plate, the first sensor V14 being engaged by the cover plate 71 when in its first position, the second sensor V15 being engaged by the cover plate when in its second position for actuating the cylinder units 77 to return the cover plate to its first position.

Figure 6A:
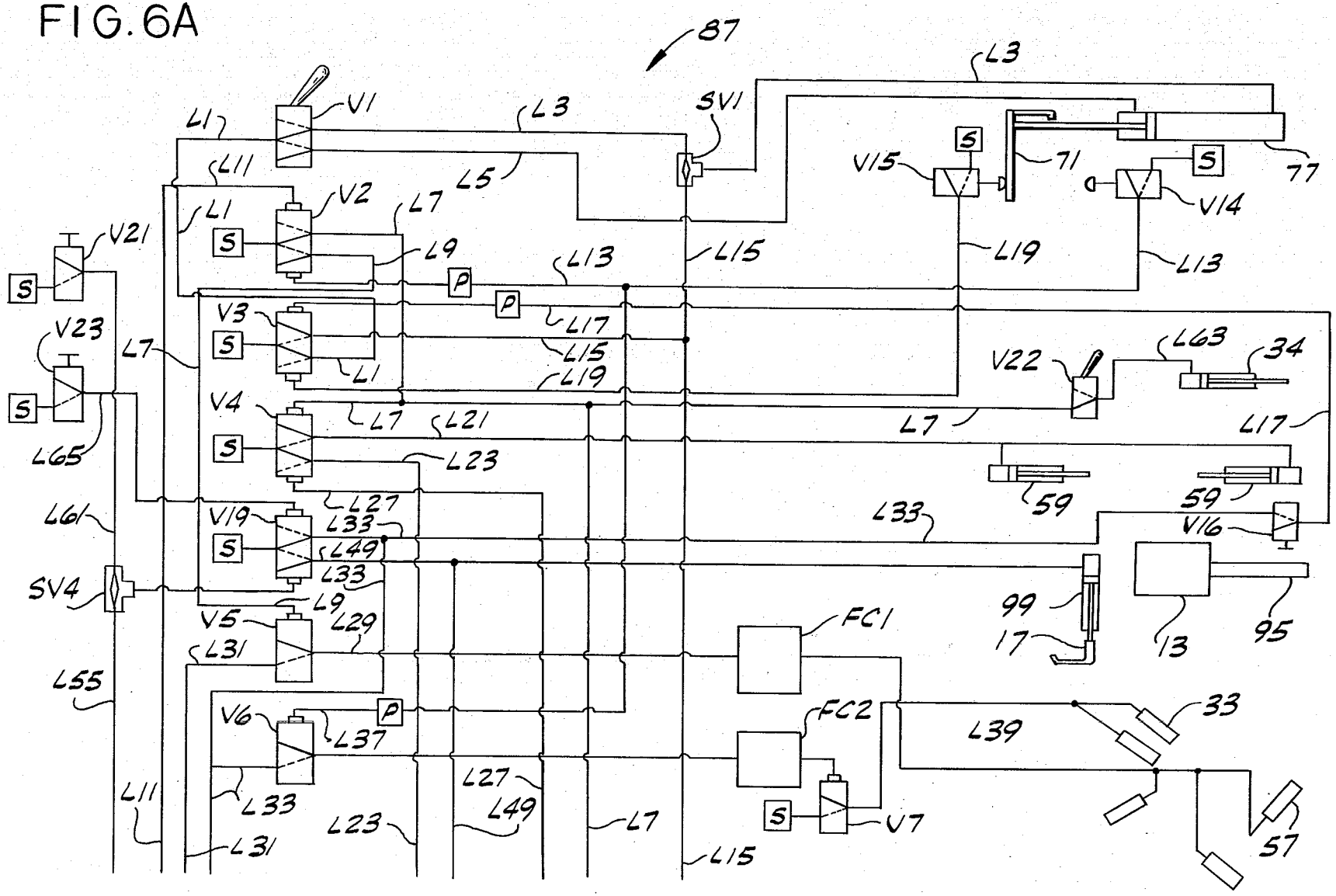
FIGS. 6A and 6B are schematics of a pneumatic control circuit of this apparatus, FIG. 6B being a continuation of FIG. 6A.
Figure 6B:
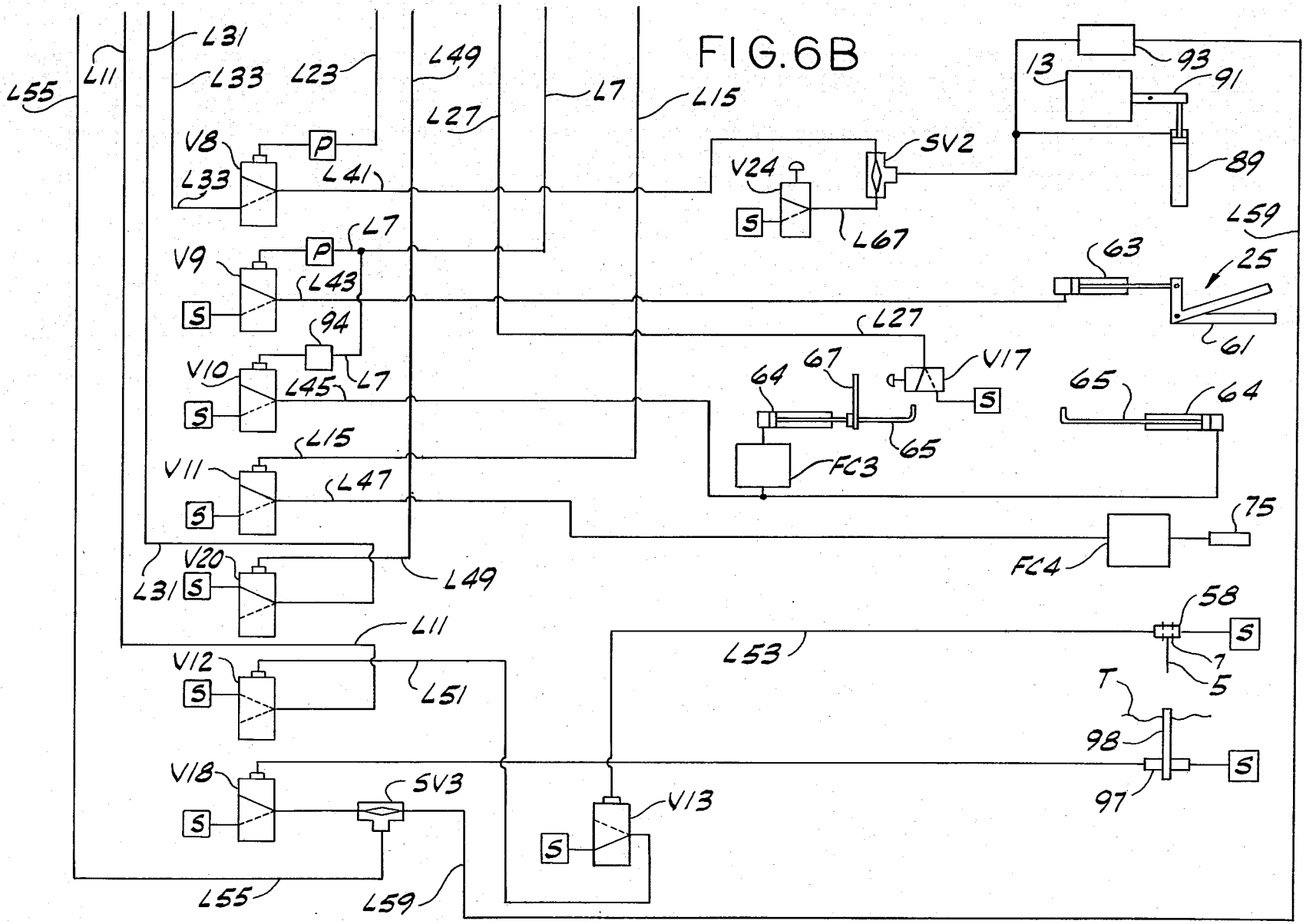

A pneumatic control circuit indicated at 87 in FIGS. 6A and 6B is provided for programming the operation of the apparatus 1 for a loop forming cycle comprising the steps of feeding the material 5 into the guide means 23, cutting a length of the material, folding the ends 7, 9 of the length of the material, stitching the ends together to form a completed loop 3, and removing the completed loop. The control circuit comprises a series of valves V1–V24 and a source of air under pressure indicated at S directly connected to certain of the valves, the source of air being shown in FIGS. 6A and 6B adjacent each valve to which it is directly connected to simplify the schematic representation of the circuit. The valve V1 is a manually operated valve connected at L1 to the valve V3, at L3 to the head ends of the cylinder units 77 via a shuttle valve SV1 and at L5 to the rod ends of the cylinder units 77. The valve V1 is manually movable between a "run" position for enabling operation of the apparatus 1 and a "stop" position for terminating the operation of the apparatus upon completion of a loop forming cycle.

The loop forming cycle of the apparatus 1 is programmed in part by the valves V2–V13 each of which is a pilot-air-operated valve. The valve V2 is connected at L7 to the valve V22 and to a pilot of the valves V4, V9 and V10, and at L9 to the pilot of the valve V5, the pilots of valve V2 being connected at L11 to the valve V12 and at L13 to the valve V14 via a pulse valve P. The valve V3 is connected at L15 to the head ends of the cylinder units 77 via the shuttle valve SV1 and to the pilot of the valve V11 and at L1 to the valve V1, the pilots of valve V3 being connected at L17 to the valve V16 via a pulse valve P and at L19 to the valve V15. The valve V4 is connected at L21 to the cylinder units 59 and at L23 to the pilot of the valve V8 via a pulse valve P, the pilots of wave V4 being connected at L7 to valve V2 and at L27 to the valve V17. The valve V5 is connected at L29 to the nozzle means 57 via flow control FC1 and at L31 to the valve V20, the pilot of valve V5 being connected at L9 to valve V2. The valve V6 is connected at L33 to the valve V19 and at L35 to the pilot of the valve V7 via flow control FC2, the pilot of valve V6 being connected at L37 to the valve V14 via a pulse valve P. The valve V7 is connected at L39 to the nozzles 33. The valve V8 is connected at L33 to the valve V19 and at L41 via a shuttle valve SV2 to an air cylinder unit 89 for moving a link 91 initiating a programmed sewing cycle of the sewing machine 13 and to counting apparatus generally designated at 93 for counting the loops 3 being formed, the pilot of the valve V8 being connected at L23 to valve V4 via a pulse valve P. The valve V9 is connected at L43 to the cylinder unit 63, the pilot of valve V9 being connected at L7 to the valve V2 via a pulse valve P. The valve V10 is connected at L45 to the cylinder units 64, a flow control FC3 being in the connection to one of the cylinder units, the pilot of valve V10 being connected at L7 to the valve V2 via a snap-acting valve 94 delaying the setting of the valve V10 relative to that of the valve V9. The valve V11 is connected at L47 to the nozzle 75 via flow control FC4, the pilot of valve V11 being connected at L15 to valve V3. The valve V12 is connected at L11 to a pilot of valve V2, the pilot of valve V12 being connected at L51 to valve V13. The pilot of valve V13 is connected at L53 to the sensor 58 on the exit reach 39 of the guide means 23 and operates as an inverter so that upon entry of the material 5 into an air gap in the sensor 58 the valve V12 is moved to position where pilot air is supplied to the valve V2.

The loop forming cycle is further programmed by the valves V14–V17 each of which is a mechanically operated valve. The valve V14 is connected at L13 and L37 to a pilot of the valves V2 and V6, the valve V14 being engaged by the cover plate 71 when in its first position. The valve V15 is connected at L19 to a pilot of the valve V3, the valve V15 being engaged by the cover plate when in its second or loop-removing position. The valve V16 is connected at L33 to the valve V19 and at L17 to a pilot of the valve V3, the valve V16 being engaged by a suitable link 95 of the sewing machine 13 upon completion of the sewing cycle. The valve V17 is connected at L27 to a pilot of the valve V4, valve V17 being engaged by projection 67 on the folding member 65 upon completion of the folding operation.

The valves V18–V20 are connected in the control circuit for automatically stopping the operation of the apparatus 1 at the end of the programmed sewing cycle of the sewing machine, upon thread breakage or when a predetermined number of loops 3 have been made. In contrast to the valve V1 which is capable of stopping the operation of the apparatus 1 only at the end of a loop forming cycle, the valves V18–V20 operate to stop the apparatus prior to the removal of the loop from the apparatus. The valve V18 is a pilot-air-operated valve connected at L55 to a pilot of valve V19 via two shuttle valves SV3 and SV4, the pilot of valve V18 being connected at L57 to a thread breakage sensor 97 operating to supply pilot air to the valve V18 upon breakage of the thread. As shown in FIG. 6B, the sensor 97 comprises a movable valve member 98 supported by the thread T in a position blocking the flow of air through the sensor, the valve member 98, upon thread breakage, dropping down to a position unblocking the flow of air therethrough. The loop counting apparatus 93 is connected at L55 and L59 to the valve V19 to supply pilot air thereto for stopping the operation of the apparatus 1 when a predetermined number of loops have been made. The valve V19 is a pilot-air-operated valve connected at L49 to a cylinder unit 99 for raising and lowering the foot 17 of the sewing machine and to the valve V20 and at L33 to the valves V6, V8 and V16 for stopping the operation of the apparatus 1 after the programmed sewing cycle. The valve V20 is a pilot-air-operated valve connected at L49 and L31 between the valve V19 and the valve V5 and acts as an inverter.

The valves V21 and V22 are provided to enable the operator to manually stop the operation of the apparatus 1 at the end of the sewing cycle. The valve V21 is a mechanically operated valve connected at L61 to a pilot of valve V19 to provide pilot air thereto for stopping the apparatus 1. The valve V22 is a mechanically operated valve connected at L63 to the cylinder unit 34.

The valves V23 and V24 are provided to resume the operation of the apparatus 1 after it has been stopped by the operation of the valve V19. The valve V23 is a mechanically operated valve connected at L65 to a pilot of the valve V19 to supply pilot air thereto to reset it for resumption of the automatic operation of the apparatus. The valve V24 is a mechanically operated valve connected at L67 to the cylinder unit 89 via the shuttle valve SV2 for enabling manual actuation of the sewing machine 13 to repeat the sewing cycle after thread breakage.

Figure 1:
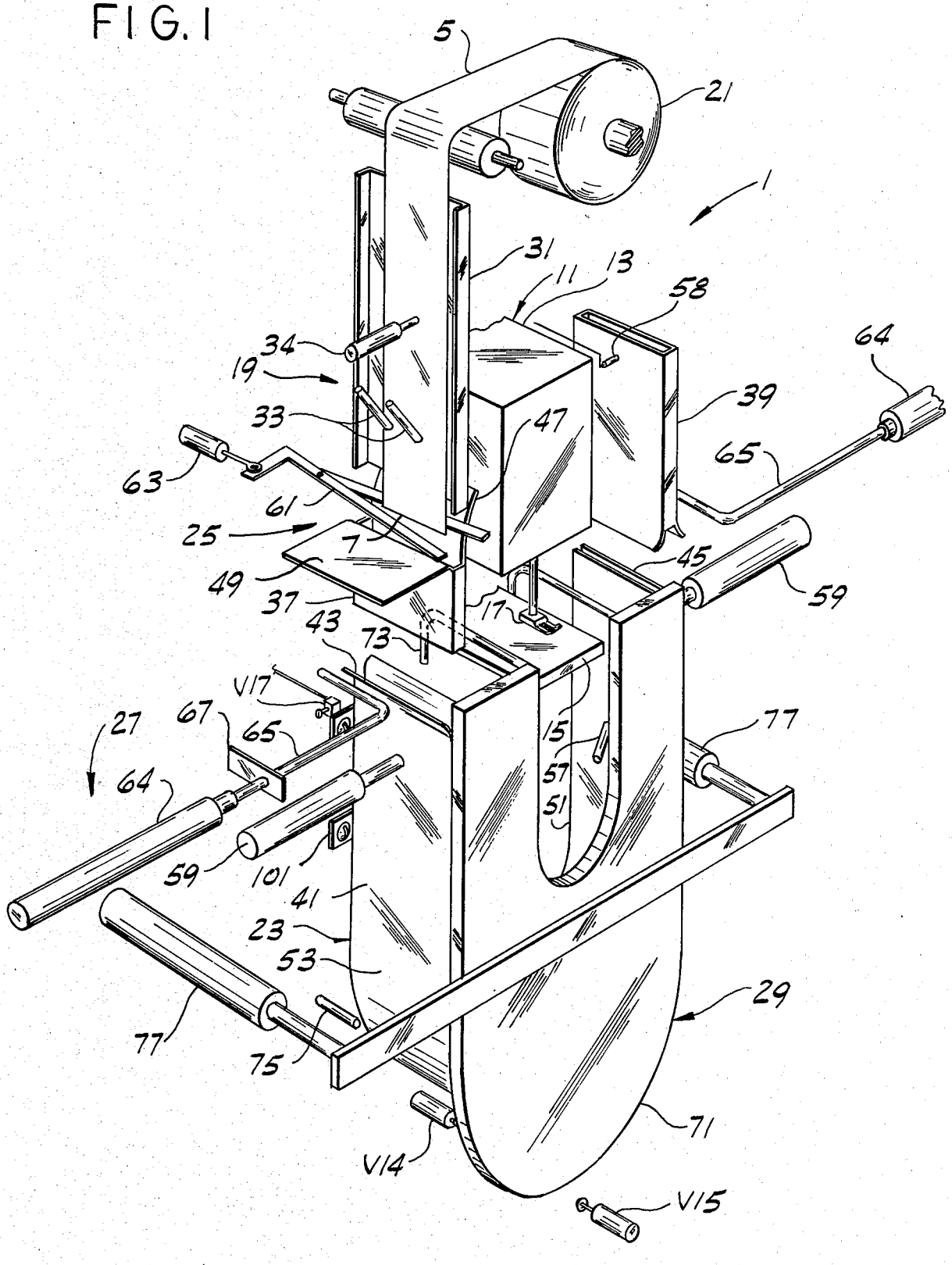
FIG. 1 is a perspective of apparatus of this invention showing strip material about to enter a guide means of the apparatus.
Figure 2:
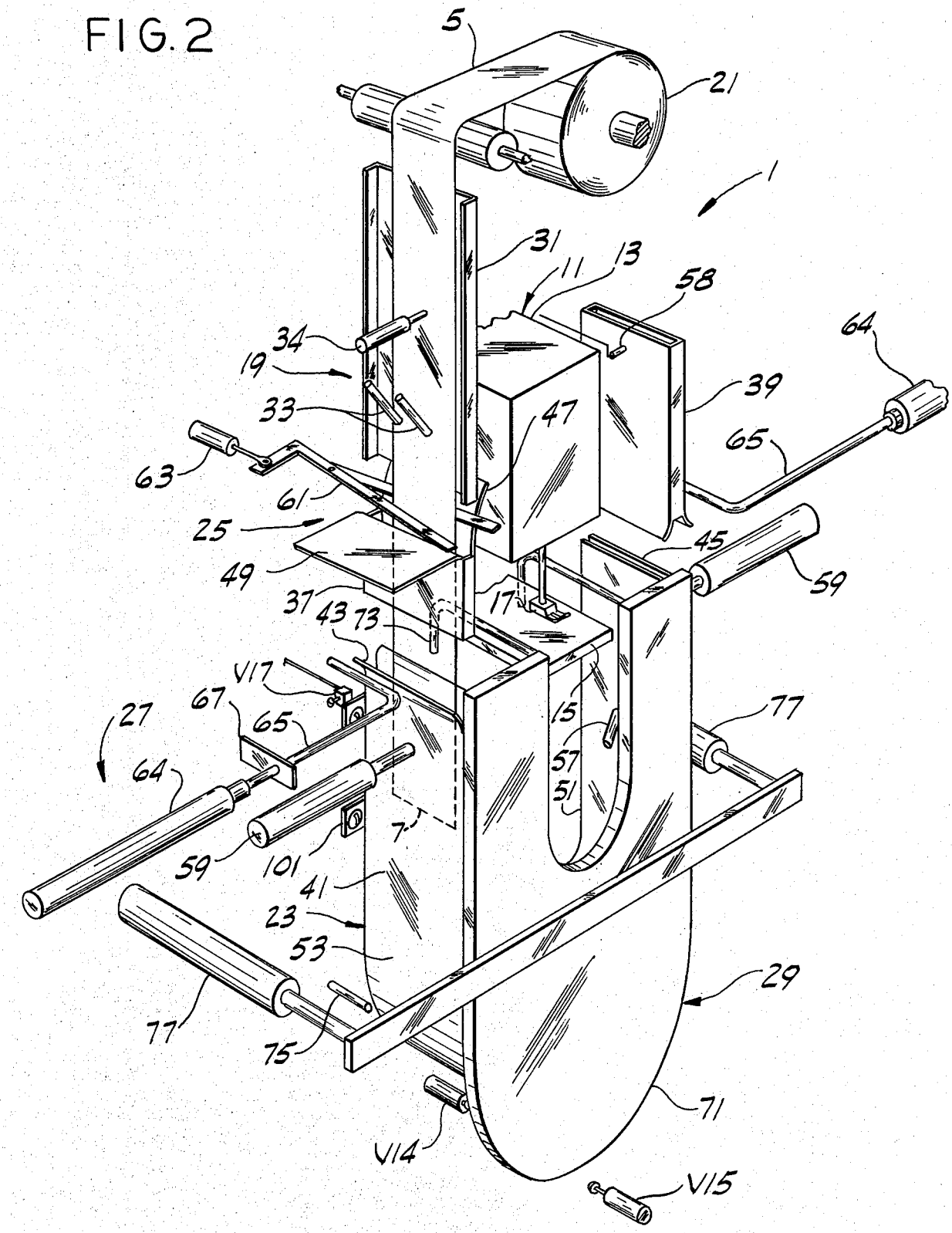
FIG. 2 is a view similar to FIG. 1 showing the leading end portion of the strip material partially fed into the guide means.
Figure 3:
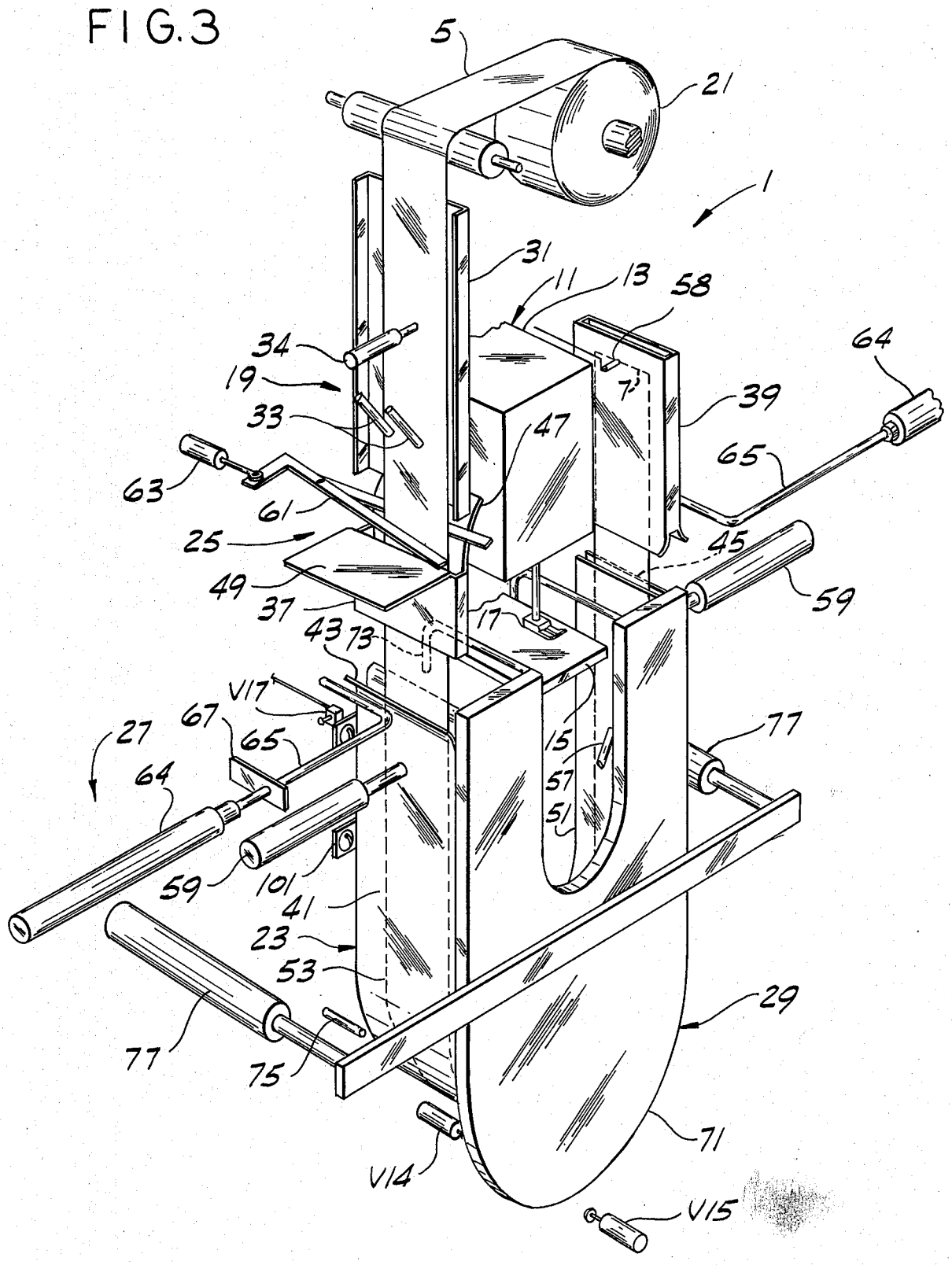
FIG. 3 is a view similar to FIG. 2 showing the strip material fed forward to the exit reach of the guide means and the material cut by a cutting means of the apparatus.
Figure 4:
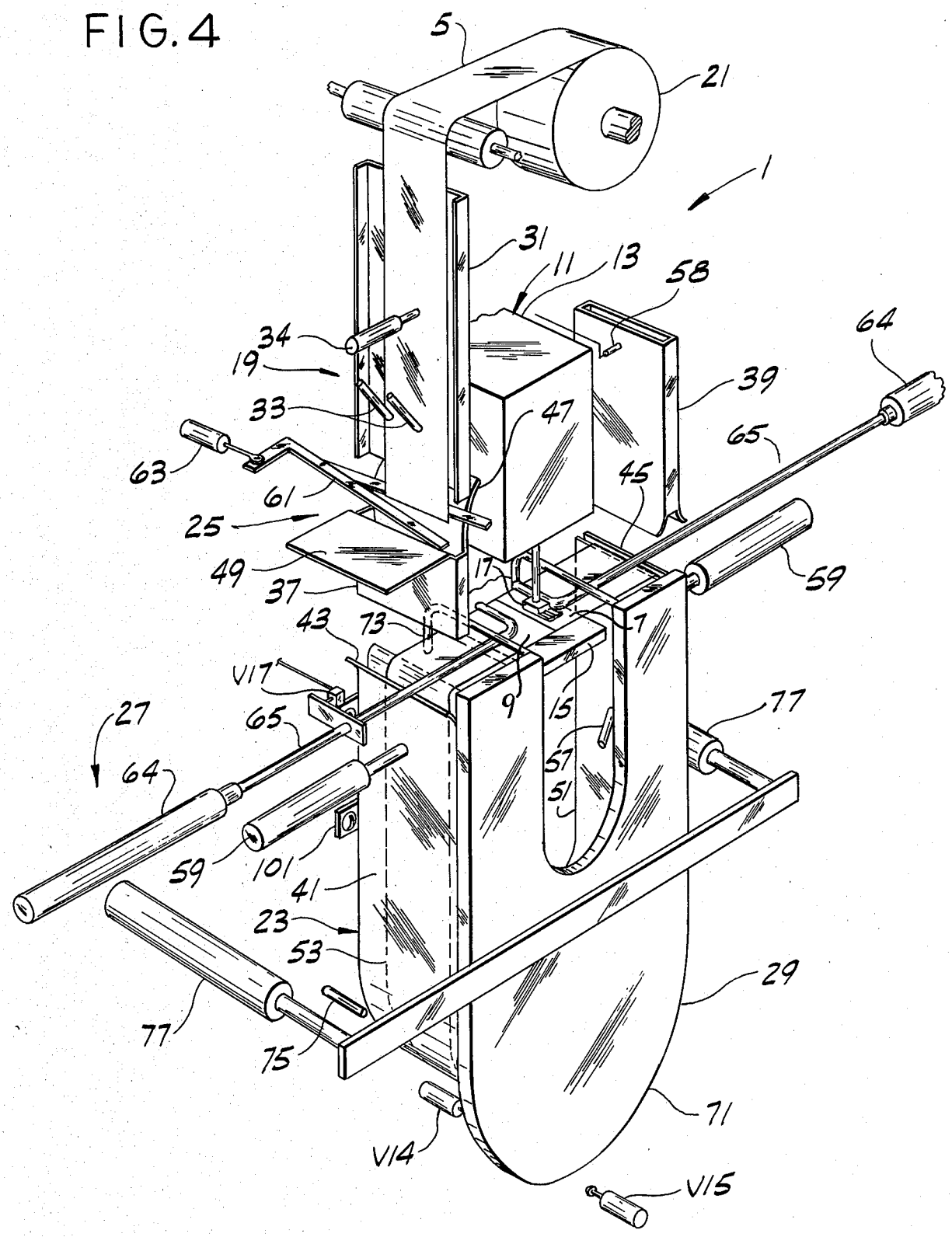
FIG. 4 is a view similar to FIG. 3 showing the ends of the length of strip material brought together in the securing means.

In the operation of the apparatus 1 through a loop forming cycle, with the cover plate 71 in its second or loop-removing position (FIG. 5) in engagement with the valve V15 to set it in position to supply pilot air to valve V3 to set it in position to supply air under pressure to valve V1, the operator sets the valve V1 in its "run" position to supply air under pressure to the rod ends of the cylinder units 77 to move the cover plate to its first position (FIG. 1), thereby initiating the loop forming cycle. When the cover plate 71 returns to its first position covering the guide means 23, it engages the valve V14 and sets it in position to supply a pulse of pilot air to the valve V6 to set it in position to supply air under pressure to the valve V7 for setting it in position to supply air under pressure to the nozzles 33, and to supply a pulse of pilot air to the valve V2. The pilot air sets the valve V2 in position to block the flow of air under pressure to the cylinder unit 34 to release the material 5, and to supply pilot air to the valve V5 to set it in position to supply air under pressure to the nozzle means 57. The strip of material 5 is then fed forward toward and through the guide means 23 by the air directed at the material 5 by the nozzles 33, 57 until the leading end 7 of the material 5 enters the sensor 58 on the exit reach 39 of the guide means 23. Upon entry of the material 5 into the sensor 58, the flow of pilot air to the valve V13 is blocked and the valve V13 is set in to a position where the flow of pilot air to the valve V12 is blocked, the valve V12 being set in a position where pilot air is supplied to the valve V2. The pilot air sets the valve V2 in position to supply air under pressure to the cylinder unit 34 for holding the material 5 above the cutting means 25, to supply pilot air to the valve V4 to set it in position to supply air under pressure to the cylinder units 59 to hold the material in the guide means 23, and to supply pilot air to the valves V9 and V10.

With the material held in the guide means 23, the next steps of the loop forming cycle (i.e., cutting the material 5 and folding the ends 7, 9 of the material) are performed. The pilot air from the valve V2 sets the valve V9 in a position where air under pressure is supplied for a brief moment to the cylinder unit 63 of the cutting means 25 to cut the material 5. Pilot air delayed by the snap-acting valve 94 then sets the valve V10 in position where air under pressure is supplied to the cylinder units 64 for extending the folding members 65 to fold the ends 7, 9 of the material 5 over the bed 15 of the sewing machine 13, the flow control valve FC3 delaying the extension of one folding member relative to the other. Upon extension of the folding members 65, the projection 67 engages the valve V17 to set it in position to supply pilot air to the valve V4 to set it in position blocking the flow of air to the cylinder units 59 to release the cylinder units 61 holding the material 5 in the guide means 23 and to supply pilot air to the valve V8 via a pulse valve P.

With the ends, 7, 9 of the material 5 on the bed 15 of the sewing machine 13, the next stop of the loop forming cycle (i.e., stitching the ends of the material) is performed. The pulse of pilot air from the valve V4 sets the valve V8 in position to supply air under pressure to the cylinder unit 89 to initiate operation of the sewing machine 13 which operates through its entire sewing cycle upon being actuated, and to supply air under pressure to the loop counting apparatus 93 to count the loop 3 being formed. Upon completion of the sewing cycle, the sewing machine engages the valve V16 via the link 95 to set it in position to supply pilot air to the valve V3 via a pulse valve P.

With the ends 7, 9 sewn together to form the loop 3, the loop forming cycle is completed by removing the loop 3 from the guide means 23. The pilot air from the valve V16 sets the valve V3 in position to supply air under pressure to the head ends of the cylinder units 77 to move the cover plate 71 to its second position for removing the completed loop 3 and to supply pilot air to the valve V11 to set it in position to supply air under pressure to the nozzle 75 to assist in the removal of the loop. The cover plate 71 engages the valve V15 upon moving to its second position to set it in position to supply pilot air to the valve V3. The valve V3 supplies air under pressure to the valve V1 which, if set in its "stop" position, supplies air under pressure to the head ends of the cylinder units 77 to hold the cover plate 71 in its second position for stopping the operation of the apparatus 1, and which, if set in its "run" position, supplies air under pressure to the rod ends of cylinder units 77 to return the cover plate 71 to its first position for starting another loop forming cycle of the apparatus 1.

If during the operation of the apparatus 1 thread breakage should occur, the apparatus is automatically stopped at the end of the sewing cycle by the thread break sensor 97, the sensor supplying pilot air to the valve V18 to set it in position to supply pilot air to the valve V19 via the shuttle valves SV3 and SV4. The pilot air sets the valve V19 in position to supply air under pressure to the cylinder unit 99 to hold the foot 17 down to enable rethreading of the needle, to supply pilot air to the inverter valve V20 to block the flow of air to the valve V5 and thus the flow of air to the nozzle means 57, and to block the flow of air to the valves V6, V8 and V16 for blocking the flow of air to the feed nozzles 33, and to the valve V16 for disabling the operation of the loop removing means 29. After the operator rethreads the needle of the sewing machine, the operator sets the valve V24 in position to actuate the machine 13 for another sewing cycle, and sets the valve V23 in position to reset the apparatus 1 for automatic operation. The valve V23 supplies pilot air to the valve V19 to reset it in position where air under pressure is supplied to the valves V16 for enabling actuation of the loop removing means at the end of the sewing cycle.

To automatically stop the operation of the apparatus 1 when a predetermined number of loops have been made, pilot air is supplied from the loop counting apparatus 93 to the valve V19 via the shuttle valves SV3 and SV4. The pilot air sets the valve V19 in position to block the flow of air under pressure through the nozzles 33, 57, and to disable the loop removing means 29. To resume operation of the apparatus 1, the operator moves the valve V23 to position to reset the valve V19.

The operation of the apparatus 1 may be stopped manually by the operator by setting the valve V21 in position where pilot air is supplied to the valve V19. The operation of the valve V19 upon receiving pilor air from the valve V21 for stopping the operation of the apparatus 1 is similar to that described above.

While the apparatus 1 as shown and described above produces loops of only a single predetermined peripheral length, the central reach 41 may be replaced by another central reach generally similar in construction and configuration to the central reach 41 but having a different peripheral length for forming loops 3 of other peripheral lengths. Each central reach is adapted to be detachably secured to a support (not shown) by conventional fastening means such as bolts 101 or quick release mechanisms to facilitate its replacement. The cover plate 71 is so sized and configured to engage the inner and outer members 51, 53 of the central reach regardless of its peripheral length.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for forming loops of strip material, with each loop comprising a length of the material having its ends secured together comprising:

means for securing the ends of a length of the strip material together to form it into a closed loop;

means for intermittently feeding a length of strip material from a supply;

means for guiding the leading end portion of the strip material as it is fed forward from the supply generally into the form of a U extending in one direction on one side of said securing means and back in the opposite direction on the other side of said securing means;

means for cutting the strip material at the trailing end of the U-shaped leading end portion of the strip material to provide a generally U-shaped length of the material with the sides of said U-shaped length of material extending on opposite sides of said securing means; and means for folding over the ends of said U-shaped length of material to bring them together in the securing means for being secured together by the latter, said securing means being operable upon the folding over of said ends for securing them together.

2. Apparatus as set forth in claim 1 wherein said securing means comprises a sewing machine having a bed supporting the folded-over ends of said U-shaped length of material.

3. Apparatus as set forth in claim 1 wherein the feeding means comprises means backing the strip material led from the supply to the guiding means, and a nozzle for directing air under pressure at the material to feed it forward toward the guide means.

4. Apparatus as set forth in claim 1 wherein the securing means and guiding means are formed to enable edgewise removal of each completed loop, and wherein means is provided for removing each completed loop edgewise from the securing means and the guiding means.

5. Apparatus as set forth in claim 4 wherein the guide means has an entry reach, an exit reach, and a U-shaped central reach, the central reach comprising an inner member and an outer member in spaced relation relative to the inner member.

6. Apparatus as set forth in claim 5 having means for holding the strip material in the guide means against longitudinal movement while the material is being cut and the ends of the U-shaped length of material are being folded and secured together.

7. Apparatus as set forth in claim 5 wherein the central reach further comprises an edge member extending between the inner and outer members, the edge member being movable between a first position in engagement with the inner and outer members and a second position away from the inner and outer members enabling edgewise removal of the completed loop from the guide means.

8. Apparatus as set forth in claim 7 wherein the removing means comprises a cover plate functioning as said edge member, and a hook extending laterally from the cover plate engageable with an edge of the loop for removing the loop from the guide means upon movement of the cover plate away from the inner and outer members.

9. Apparatus as set forth in claim 7 wherein said securing means comprises a sewing machine having a bed, the guide means extending down on one side of the bed of the sewing machine and back up on the other side of the bed, the entry reach having upper and lower ends, the exit reach having upper and lower ends, the central reach having an entrance end below the lower end of the entry reach and an exit end below the lower end of the exit reach, the ends of the central reach being generally at the level of the bed of the sewing machine.

10. Apparatus as set forth in claim 9 further comprising air nozzle means for directing air under pressure between said inner and outer members of the central reach toward the exit end of the central reach for feeding the strip material through the guide means.

11. Apparatus as set forth in claim 9 wherein the entry reach comprises inner and outer members, said members of the entry reach being outwardly divergent at the entry end of the entry reach.

12. Apparatus as set forth in claim 9 wherein the folding means comprises two folding members each movable from a retracted position outward of the central reach to an extended position over the bed of the sewing machine, one folding member being movable between the lower end of the entry reach and the entrance end of the central reach, the other folding member being movable between an exit end of the central reach and the lower end of the exit reach.

13. Apparatus for forming loops of strip material, with each loop comprising a length of the material having its ends secured together, comprising:

a sewing machine for sewing the ends of a length of the material together to form it into a closed loop, the sewing machine having a bed;

means for intermittently feeding a length of strip material from a supply;

means for guiding the leading end portion of the strip material as it is fed forward from the supply generally into the form of a U extending down on one side of the bed of the sewing machine and back up on the other side of the bed, the guide means comprising an entry reach having upper and lower ends, an exit reach having lower and upper ends and a U-shaped central reach having an entrance end below the lower end of the entry reach and an exit and below the lower end of the exit reach, the ends of the central reach being generally at the level of the bed of the sewing machine;

means for cutting the strip material at the trailing end of the U-shaped leading end portion of the strip material to provide a generally U-shaped length of the material with the sides of said U-shaped length of material extending on opposite sides of the bed of the sewing machine, the cutting means being above the upper end of the entry reach;

means for folding over the ends of said U-shaped length to bring them together on the bed of the sewing machine for being stitched together by the sewing machine, the folding means comprising two folding members each movable from a retracted position outward of the guide means to an extended position over the bed of the sewing machine, one of the folding members being movable between the lower end of the entry reach and the entrance end of the central reach, the other folding member being movable between the exit end of the central reach and the lower end of the exit reach, said sewing machine being operable upon the folding over of said ends for stitching them together.

14. Apparatus as set forth in claim 13 wherein the feeding means comprises means backing the strip material led from the supply to the guiding means, and a nozzle for directing air under pressure at the material to feed it forward toward the guide means.

15. Apparatus as set forth in claim 13 wherein the sewing machine and guiding means are formed to enable edgewise removal of each completed loop, and wherein means is provided for removing each completed loop edgewise from the sewing machine and the guiding means.

16. Apparatus as set forth in claim 15 wherein the guide means has an entry reach, an exit reach, and a U-shaped central reach, the central reach comprising an inner member and an outer member in spaced relation relative to the inner member.

17. Apparatus as set forth in claim 16 having means for holding the strip material in the guide means against longitudinal movement while the material is being cut and ends of the U-shaped length of material are being folded and secured together.

18. Apparatus as set forth in claim 16 wherein the central reach further comprises an edge member extending between the inner and outer members, the edge member being movable between a first position in engagement with the inner and outer members and a second position away from the inner and outer members enabling edgewise removal of the completed loop from the guide means.

19. Apparatus as set forth in claim 18 wherein the removing means comprises a cover plate functioning as said edge member, and a hook extending laterally from the cover plate engageable with an edge of the loop for removing the loop from the guide means upon movement of the cover plate away from the inner and outer members.

20. Apparatus as set forth in claim 18 further comprising air nozzle means for directing air under pressure between said inner and outer members of the central reach toward the exit end of the central reach for feeding the strip material through the guide means.

21. Apparatus as set forth in claim 18 wherein the entry reach comprises inner and outer members, said members of the entry reach being outwardly divergent at the entry end of the entry reach.

* * * * *